US007399212B2

(12) United States Patent
Okuyama

(10) Patent No.: US 7,399,212 B2
(45) Date of Patent: Jul. 15, 2008

(54) BOAT

(75) Inventor: Takashi Okuyama, Shizuoka-ken (JP)

(73) Assignee: Yamaha Marin Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/529,142

(22) Filed: Sep. 28, 2006

(65) Prior Publication Data

US 2007/0082567 A1 Apr. 12, 2007

(30) Foreign Application Priority Data

Sep. 28, 2005 (JP) ..... 2005-282434

(51) Int. Cl.
*B63H 23/00* (2006.01)

(52) U.S. Cl. ..... 440/84; 440/1

(58) Field of Classification Search ..... 440/1, 440/84, 53; 74/480 B
See application file for complete search history.

(56) References Cited

U.S. PATENT DOCUMENTS 4,836,809 A * 6/1989 Pelligrino ..... 440/84
6,485,340 B1 * 11/2002 Kolb et al. ..... 440/84
7,142,955 B1 * 11/2006 Kern et al. ..... 440/84
2003/0092331 A1 * 5/2003 Okuyama ..... 440/84
2004/0237870 A1 * 12/2004 Clarke et al. ..... 114/259

FOREIGN PATENT DOCUMENTS

JP 05-152996 6/1993
JP 2003-200895 7/2003

* cited by examiner

*Primary Examiner*—Lars A Olson
(74) *Attorney, Agent, or Firm*—Knobbe, Martens, Olson & Bear, LLP

(57) ABSTRACT

A boat can include batteries, a generator, a remote control unit provided in a hull, and an outboard motor controlled through the remote control unit so as to generate thrust. The batteries and the generator can be connected to the remote control unit and the outboard motor via power supply cables. The remote control unit and the outboard motor can be connected via drive by wire controller area network ("DBW CAN") cables . At least two systems of power supply cables and at least two systems of DBW CAN cables can also be provided.

6 Claims, 5 Drawing Sheets

BOAT

PRIORITY INFORMATION

This application is based on and claims priority under 35 U.S.C. §119 to Japanese Patent Application No. 2005-282434, filed on Sep. 28, 2005, the entire contents of which is hereby expressly incorporated by reference herein.

BACKGROUND OF THE INVENTIONS

1. Field of the Inventions

The present inventions relate to boats having electrically controlled boat propulsion units for producing thrust according to the operation of remote control units provided in a hull of the associated boat.

2. Description of the Related Art

In some known conventional boats, outboard motors provided at the stern of the hull of the boat are controlled by a remote control unit provided near an operator's seat of the boat. When the remote control unit is operated, the throttle opening and or other devices of the outboard motor, such as the engine, are controlled so as to drive the device, such as the engine, in a desired manner.

The outboard motor, which can serve as the propulsion unit of the boat, and the remote control unit can be connected to a power source via a power supply line. Additionally, the boat propulsion unit and the remote control unit can be connected to each other via a communication line.

Electric power is supplied from the power source to the boat propulsion unit and the remote control unit via the power supply line, and signals such as a target throttle opening signal and a target shift position signal are sent from the remote control unit to the boat propulsion unit via the communication line, thereby allowing the boat to run. Examples of this type of boat are disclosed in Japanese Patent Documents JP-A-Hei 5-152996 and JP-A-2003-200895 1, for example.

SUMMARY OF THE INVENTIONS

In boats such as those disclosed in Japanese Patent Documents JP-A-Hei 5-152996 and JP-A-2003-200895 1, the boat propulsion unit and the remote control unit do not operate normally in the case where at least one of the power supply line and the communication line is broken or otherwise disconnected.

An aspect of at least one of the embodiments disclosed herein includes the realization that the reliability of a boat can be enhanced by providing redundant power supply and/or communications connections. For example, such redundant connections can allow a boat propulsion unit and a remote control unit to operate normally even when a breakage or other failure occurs in a power supply line or a communication line.

Thus, in accordance with an embodiment, a boat can comprise a hull, a power source, and a remote control unit provided in the hull. A boat propulsion unit can be controlled through the remote control unit so as to produce thrust for propelling the hull. Additionally, the power source \can be connected to the remote control unit and the boat propulsion unit with at least two systems of power supply lines, and the remote control unit and the boat propulsion unit being connected to each other with at least two systems of communication lines.

In accordance with another embodiment, a vehicle can comprise a power source, a remote control unit, and a propulsion unit controlled through the remote control unit so as to produce thrust for propelling the vehicle. At least two systems of power supply lines can connect the power source with the remote control unit and the propulsion unit. Additionally, at least two systems of communication lines connecting the remote control unit and the propulsion unit.

In accordance with yet another embodiment, a boat can comprise a power source, a remote control unit, and a propulsion unit controlled through the remote control unit so as to produce thrust for propelling the boat. The boat can also include means for providing redundant connections from the power source to the remote control unit and the boat propulsion unit, and means for providing redundant communications connections between the remote control unit and the boat propulsion unit.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

FIGS. 1 to 5 illustrate various embodiments in the context of a boat 11. The inventions disclosed herein are described in the context of a boat because they have particular utility in this context. However, the inventions herein can also be used in other contexts as well, such as, for example, but without limitation, larger boats, smaller boats, land vehicles and air vehicles.

Figure 1:
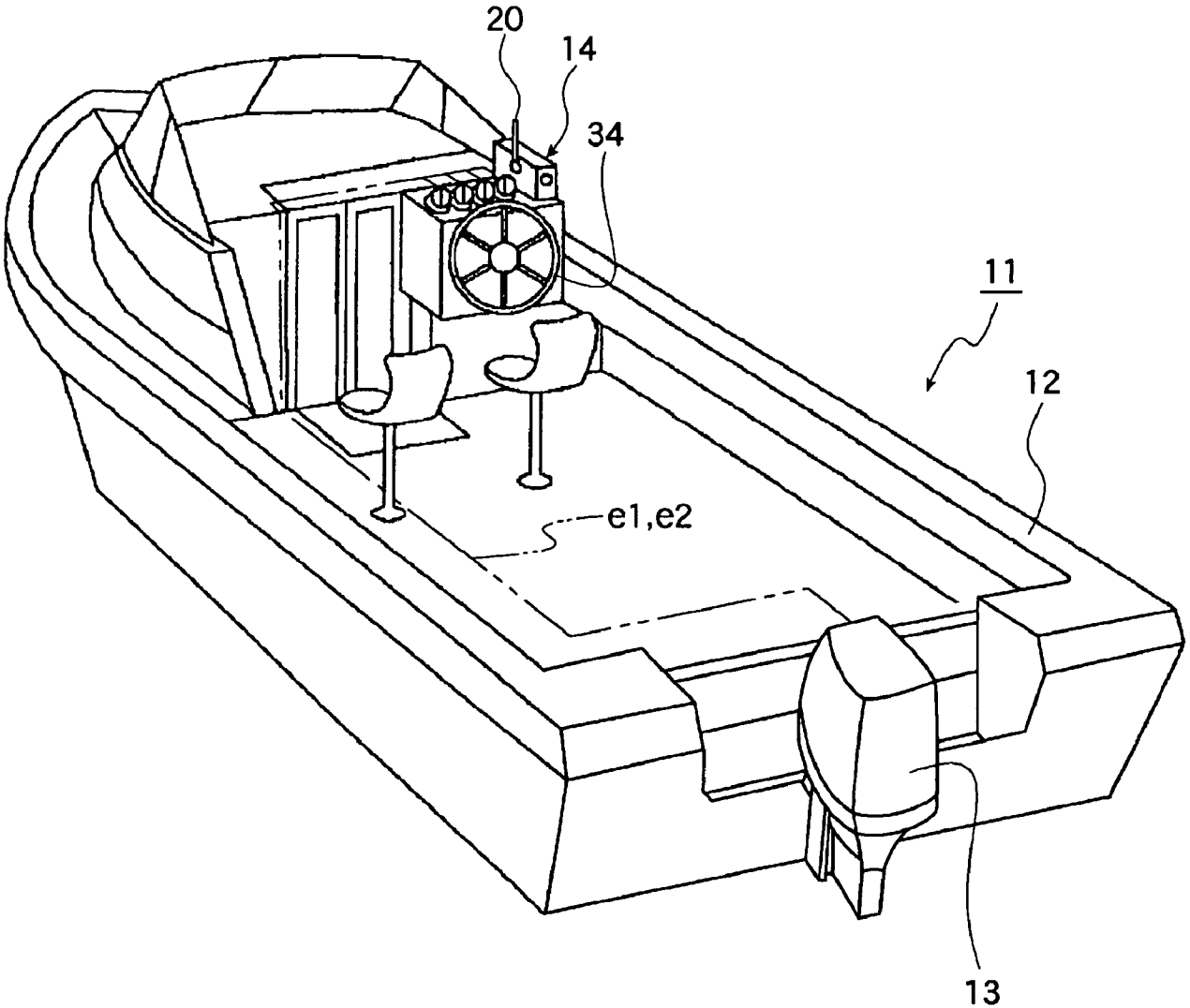
FIG. 1 is a perspective view of a boat having a wiring arrangement according to an embodiment.

With reference to FIG. 1 the boat 11 can include an outboard motor 13. In some embodiments, the outboard motor 13 can serve as a "boat propulsion unit". As such, the outboard motor 13 can be attached to the stern of a hull 12. The outboard motor 13 can be operated through a remote control unit 14, a steering wheel unit 15 and a key switch unit 16 provided around an operator's seat. However, other units and configurations can also be used.

Figure 3:
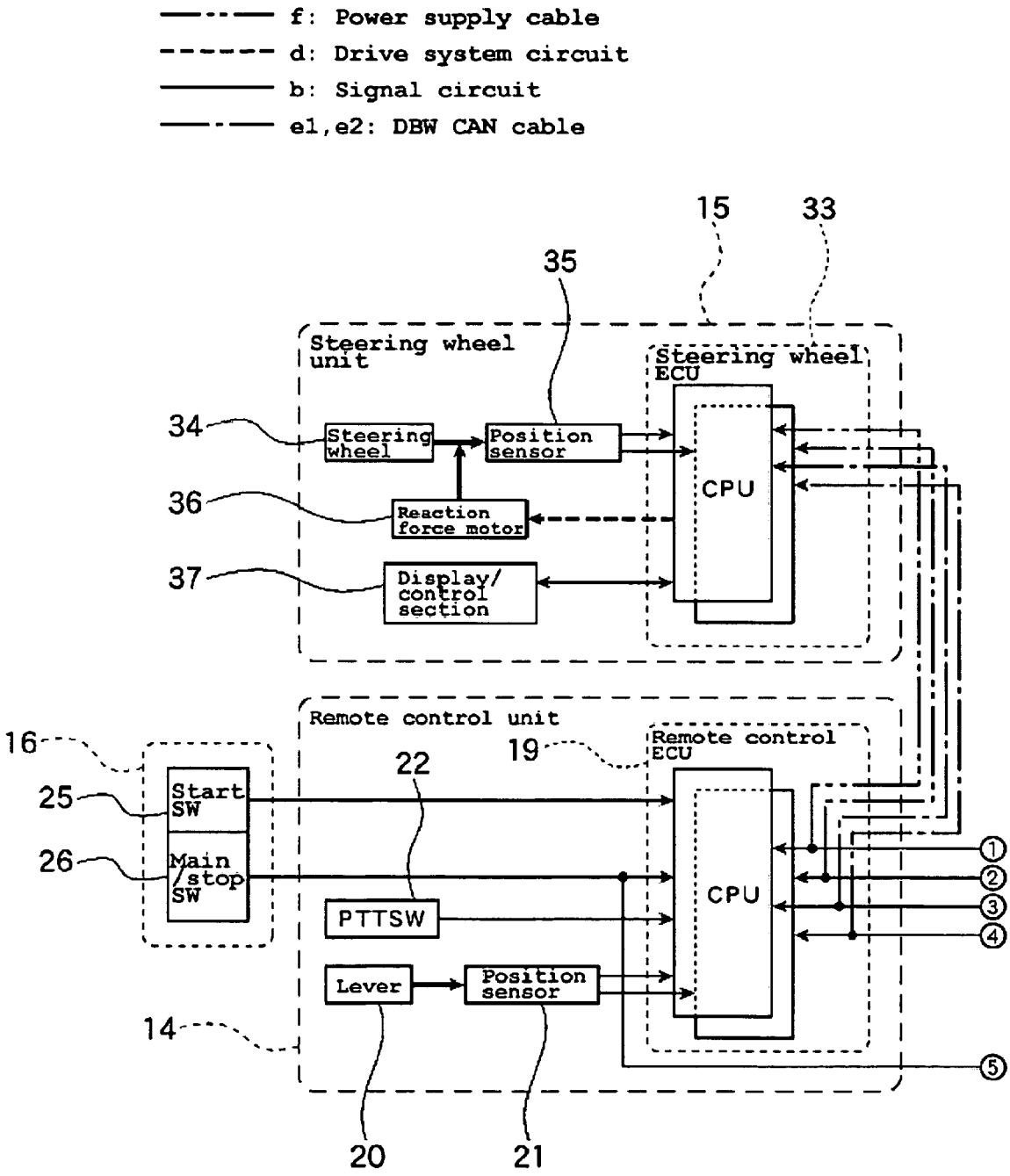
FIG. 3 is a block diagram of a remote control unit, a steering wheel unit, and a key switch unit that can be used with the boat of FIG. 1 and the wiring system of FIG. 2.

The remote control unit 14 can include a remote control ECU 19 built in a remote control body 18. As shown in FIG. 3, the rotational position of a remote control lever 20 can be detected by a position sensor 21. The position sensor 21 can be connected to the remote control ECU 19 via two signal circuits "b". A PTT (power trim and tilt) switch 22 can be connected to the remote control ECU 19 via a signal circuit "b". However, other circuits can also be used.

The key switch unit 16 can be connected to the remote control ECU 19 of the remote control unit 14. The key switch unit 16 can be provided with a start switch 25 and a main/stop switch 26 and/or other switches. The start switch 25 and the main/stop switch 26 can be connected to the remote control ECU 19 via signal circuits "b". However, other circuits can also be used.

Figure 2:
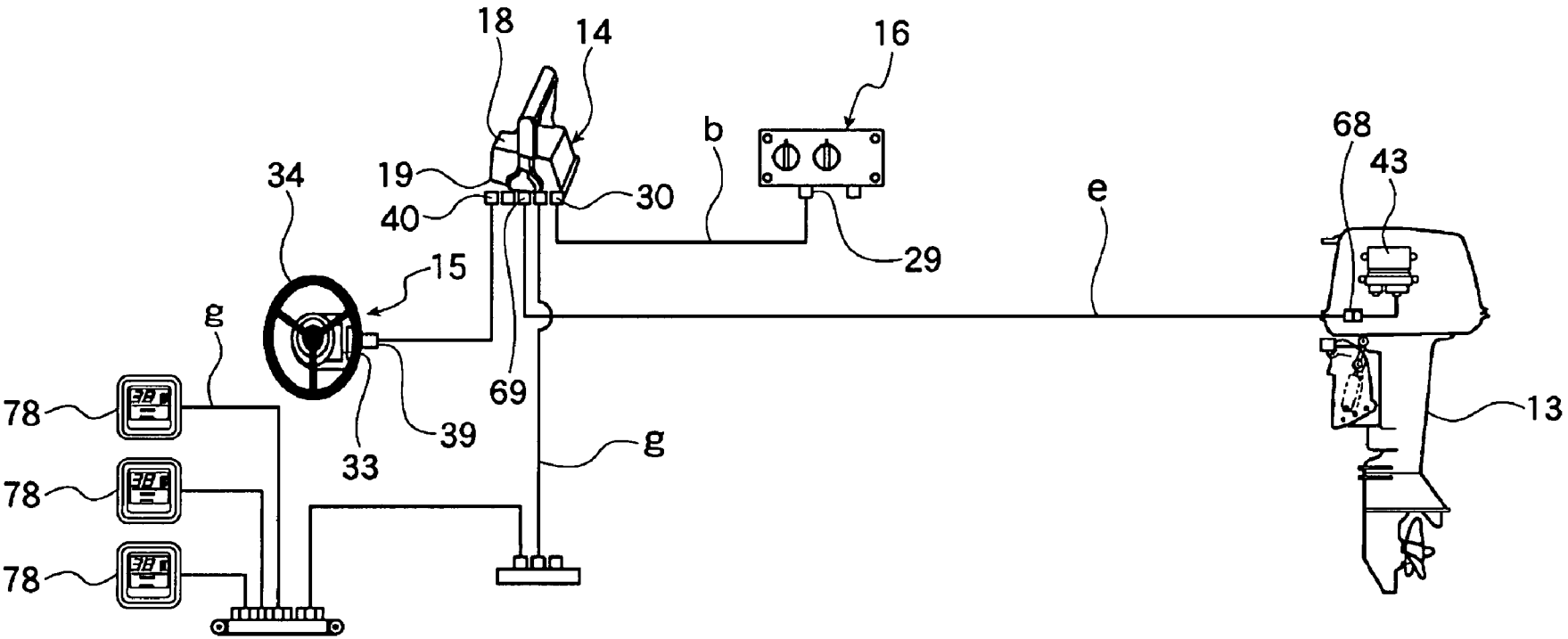
FIG. 2 is a schematic diagram of a wiring system that can be used with the boat of FIG. 1.

As shown in FIG. 2, the signal circuits "b" for connection between the start switch 25 and the remote control ECU 19, and between the main/stop switch 26 and the remote control ECU 19, are disconnectable from the key switch unit 16 via connectors 29, and disconnectable from the remote control unit 14 via connectors 30. However, other types of connectors and/or connections can also be used.

With reference to FIG. 3, the steering wheel unit 15 can include a built-in steering wheel ECU 33 and a steering wheel 34. The steering wheel 34 can be connected to a position sensor 35 for detecting the position of the steering wheel 34. The position sensor 35 can be, in turn, connected to the steering wheel ECU 33 via signal circuits "b".

A reaction force motor 36 can also be connected to the steering wheel ECU 33. The reaction force motor 36 can be configured to apply a reaction force to the steering wheel 34 via a drive system circuit "d". Further, a display/control section 37 can also be connected to the steering wheel ECU 33. The display/control section 37 can be configured to change the mode of a steering system via a signal circuit "b". For example, the display/control section 37 can be configured to allow a user to input a command, through the actuation of a button, a switch, or other device, to change a mode of the steering system. The drive system circuit "d" can be a circuit for sending drive signals.

The steering wheel ECU 33 of the steering wheel unit 15 can be connected to the remote control ECU 19 of the remote control unit 14 via two DBW CAN cables "e1", "e2" as "signal lines". Here, the term "DBW" is an abbreviation for "Drive-By-Wire", and refers to a manipulation device through electrical connection instead of mechanical connection. Also, the term "CAN" is an abbreviation for "Controller Area Network".

As shown in FIG. 2, the DBW CAN cables "e1", "e2" for connection between the steering wheel ECU 33 and the remote control ECU 19 are disconnectable from the steering wheel unit 15 via connectors 39, and disconnectable from the remote control unit 14 via connectors 40. However, other connectors and/or connections can also be used.

Figure 4:
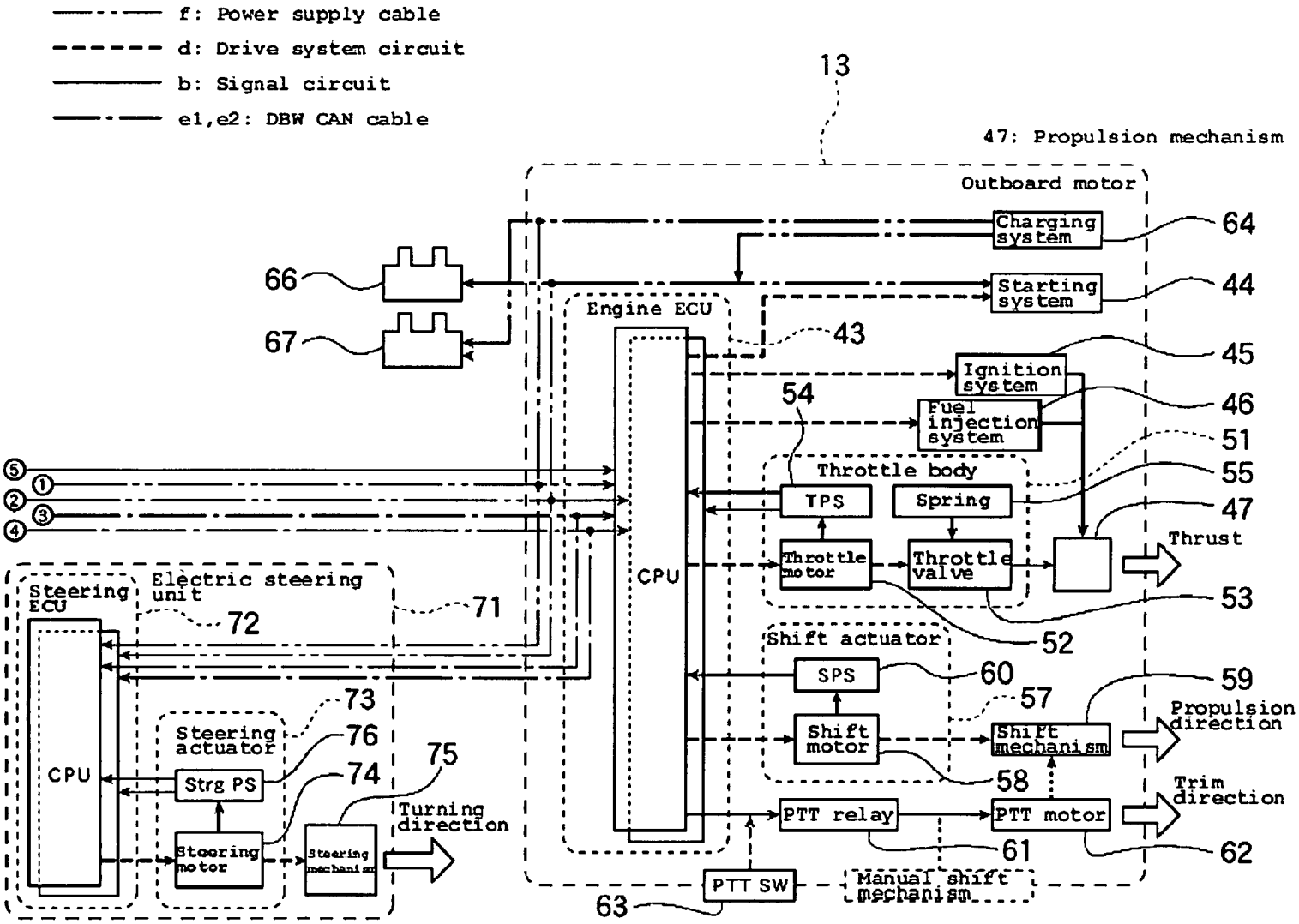
FIG. 4 is a block diagram of an outboard motor and a steering unit that can be used with the boat of FIG. 1 and the systems illustrated in FIGS. 2 and 3.

With reference to FIG. 4, the outboard motor 13 can includes an engine ECU 43, which can be referred to as "a propulsion unit ECU". The engine ECU 43 can be connected to a starting system 44, an ignition system 45, a fuel injection system 46, and/or other systems via drive system circuits "d". However, other arrangements can also be used. A propulsion mechanism (engine) 47 can be driven by the starting system 44, the ignition system 45, the fuel injection system 46, etc. to produce thrust for propelling the boat 11.

The engine ECU 43 can also be connected to a throttle motor 52 of a throttle body 51 via a drive system circuit "d". However, other circuits can also be used.

The throttle opening of a throttle valve 53 can be controlled through the throttle motor 52 such that the propulsion mechanism 47 can be driven at a desired speed, torque, or power output level. The throttle body 51 can also be provided with a throttle position sensor 54 configured to detect the throttle opening. A spring 55 can be configured to urge or bias the throttle valve 53 toward the closing direction. A signal from the throttle position sensor 54 can be input to the engine ECU 43.

In addition, a shift motor 58 of a shift actuator 57 can be connected to the engine ECU 43 via a drive system circuit "d". However, other circuits can also be used.

The shift motor 58 can be configured to drive a shift mechanism 59 to control the propulsion direction (e.g., to shift between forward, neutral, or reverse modes). The shift actuator 57 can be also provided with a shift position sensor 60 configured to detect the shift position. A signal from the shift position sensor 60 can be input to the engine ECU 43.

Further, a PTT relay 61 can be connected to the engine ECU 43 via a drive system circuit "d". However, other circuits can also be used.

The PTT relay 61 can be connected to a PTT motor 62 via a drive system circuit "d" so that the PTT motor 62 controls the trim direction. A PTT switch 63 can be connected to the PTT relay 61.

The engine ECU 43 of the outboard motor 13 can be directly connected to the remote control ECU 19 of the remote control unit 14 via DBW CAN cables "e1", "e2" (described in greater detail below).

As shown in FIG. 2, the DBW CAN cables "e1", "e2" for connection between the engine ECU 43 and the remote control ECU 19 are disconnectable from the outboard motor 13 via connectors 68, and disconnectable from the remote control unit 14 via connectors 69.

The engine ECU 43 of the outboard motor 13 can be connected to a steering ECU 72 of an electric steering unit 71 via DBW CAN cables "e1", "e2". The steering ECU 72 can be connected to a steering motor 74 of a steering actuator 73 via a drive system circuit "d". The steering motor 74 drives a steering mechanism 75 to turn the boat to a desired turning direction. The steering actuator 73 can also be provided with a steering position sensor 76 for detecting the steering position. A signal from the steering position sensor 76 can be input to the steering ECU 72.

Two batteries 66, 67, which can serve as "power sources", can be connected to the ECUs 19, 33, 43, 72, etc. via power supply cables "f". However, other types of power sources can also be used.

Figure 5:
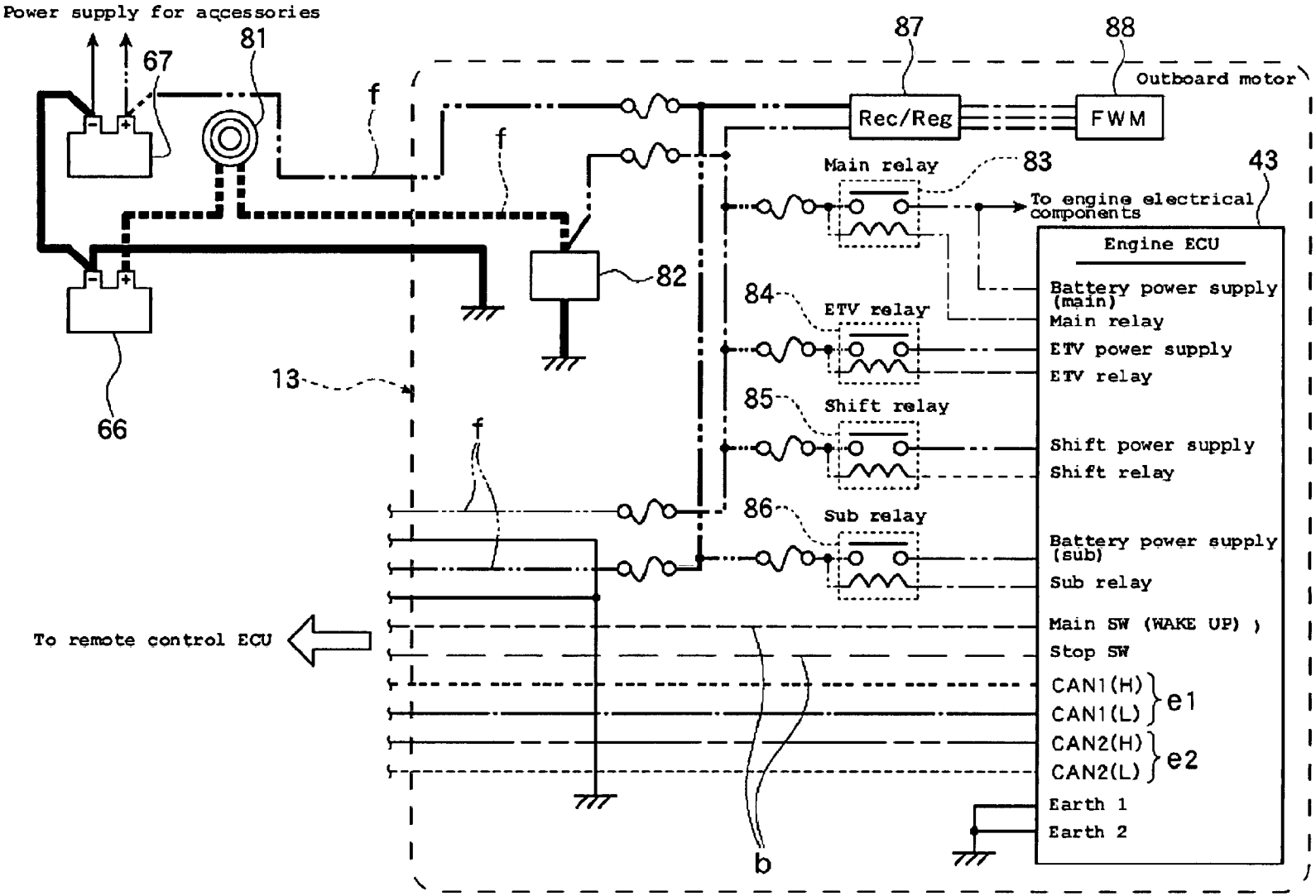
FIG. 5 is a block diagram of an arrangement of the outboard motor and a power supply that can be used with the boat of FIG. 1 and the systems illustrated in FIGS. 2-4.

In some embodiments, as shown in FIG. 5, the two batteries 66, 67 can be connected to the engine ECU 43 and the remote control ECU 19 via power supply cables "f" as two systems of "power supply lines", with a battery changeover switch 81 and a starter motor 82 connected to the battery 66, one of the batteries 66, 67, via a power supply cable "f". The battery changeover switch 81 can be configured to disconnect the circuit when the battery 66 is not used, to prevent battery drain. However, other configurations can also be used.

In some embodiments, the engine ECU 43 can be connected via a main relay 83, an ETV power supply relay 84 and a shift power supply relay 85 to a power supply cable "f", which is connected to the battery 66. The starter motor 82 can be connected via a power supply cable "f" to the remote control ECU 19, and also to a Rec/Reg (rectifier/regulator) 87. The Rec/Reg 87 can be, in turn, connected to an FWM (flywheel magnet) 88 as "power generating unit". However, other configurations can also be used.

The other system, which can be connected to the other battery 67, can be connected to the engine ECU 43 via a sub relay 86, and also to the remote control ECU 19 via a power supply cable "f". The battery 67 can be connected to the Rec/Reg 87, which can be connected to the FWM 88.

In this way, two systems of power supply cables "f" can be connected to the FWM 88. The main relay 83 can be also connected to engine electrical components.

As described above, the engine ECU 43 and the remote control ECU 19 can be electrically connected to each other via two systems of DBW CAN cables "e1", "e2" as "communication lines". The DBW CAN cable "e1" of one system includes a CAN 1 (H) and a Can 1 (L), while the DBW CAN cable "e2" of the other system includes a CAN 2 (H) and a Can 2 (L). The same signals can be sent through the two systems.

A signal can also be sent from the main/stop switch 26 to the engine ECU circuit "b".

As shown in FIG. 2, the boat 11 can be include an information system network separate from the DBW network described above. In the information system network, instrument panels 78 can be connected to the engine ECU 43 via information system cables "g" so that the instrument panels 78 display the engine speed, etc. However, other configurations can also be used.

In operation, firstly, when the start switch 25 is operated to start the outboard motor 13, a signal from the start switch 25 can be input via the remote control ECU 19 to the engine ECU 43. Then, the engine ECU 43 controls the starting system 44, the ignition system 45, the fuel injection system 46, etc. and controls the position of the throttle valve 53 through the throttle motor 52, in order to drive the propulsion mechanism 47.

When the remote control lever 20 is operated while the outboard motor 13 is running, a signal from the position sensor 21 can be input to the remote control ECU 19. The remote control ECU 19 in turn sends the signal indicating the position of the remote control lever 20 to the engine ECU 43. Then, based on the position of the remote control lever 20, the engine ECU 43 controls the rotational movement of the throttle valve 53 through the throttle motor 52, in order to achieve desired thrust through the propulsion mechanism 47 and hence a desired boat speed.

In addition, whether the remote control lever 20 is in the forward, neutral or reverse position can also be detected. Based on a signal indicating which position the remote control lever 20 is in, the engine ECU 43 controls the shift motor 58 so as to drive the shift mechanism 59, in order to determine the propulsion direction, etc.

Further, when the steering wheel 34 is rotationally moved in a certain direction to steer the boat 11, the steering wheel angle can be detected by the position sensor 35. Then, a signal indicating the steering wheel angle can be input via the steering wheel ECU 33 to the steering ECU 72. The steering ECU 72 can control the steering motor 74 so as to drive the steering mechanism 75 such that the outboard motor 13 is directed to the corresponding direction.

In the boat 11 described above, electric power from the batteries 66, 67 and the FWM 88 is respectively supplied to the engine ECU 43 and the remote control ECU 19 via two systems of power supply cables "f".

Thus, even when the power supply cable "f" of one system is broken, electric power can be respectively supplied to the engine ECU 43 and the remote control ECU 19 via the power supply cable "f" of the other system, thereby keeping the outboard motor 13 operating.

In addition, different systems of power supply cables "f" are respectively connected to the batteries 66, 67 and the FWM 88. Thus, even when the power supply cable "f" of one system, which can be connected to the battery 67 and the FWM 88, is cut or otherwise disconnected, electric power can be supplied via the power supply cable "f" of the other system, thereby keeping the outboard motor 13 operating.

Further, signals indicating the target throttle angle, the target shift position, the steering wheel angle, etc. are sent from the remote control ECU 19 to the engine ECU 43 via two systems of DBW CAN cables "e1", "e2", so that the engine ECU 43 controls the propulsion mechanism 47, etc.

Even when one of the two systems of DBW CAN cables "e1", "e2" is broken, the signals are sent from the remote control ECU 19 to the engine ECU 43 via the other system, thereby keeping the boat under control. That is, the boat can be controlled to a desired boat speed, a desired direction, etc.

The position sensor 21 for detecting the position of the remote control lever 20 can be connected to the remote control ECU 19 provided in the remote control unit 14 via at two systems of signal circuits "b". Thus, even when one of the two systems of signal circuits "b" is broken or otherwise abnormal, signals can be sent via the signal circuit "b" the other system. With this structure, important signals that influence the running condition, such as a target throttle opening signal, can be securely sent to the engine ECU 43, and the throttle opening can be controlled to a desired value, thereby improving the reliability.

The remote control ECU 19 provided in the remote control unit 14 and the engine ECU 43 provided in the outboard motor 13 are directly connected via the DBW CAN cables "e1", "e2". Since plural connections (connectors) are not provided along the cables therebetween unlike the conventional arts, unstable behavior such as sudden opening of the throttle valve can be prevented as much as possible, thereby improving the reliability.

Furthermore, the outboard motor 13 can be easily attached to and removed from the hull 12 by just connecting and disconnecting at two locations, namely the connectors 69 at the remote control unit 14 and the connectors 68 at the outboard motor 13. Thus, even users unaccustomed to the attachment work are less likely to make wrong connections.

In addition, providing the remote control unit 14 with the remote control ECU 19 can improve the extensibility. Further, providing the remote control ECU 19 within the remote control body 18 can improve the appearance quality of the remote control unit 14.

One outboard motor 13 is provided in some of the embodiments described above. The present inventions, however, are not limited thereto; two or more outboard motors can also be provided. The term "boat propulsion unit" as used herein is not limited to outboard motors. Rather, inboard-outboard motors or other types of propulsion system can also be considered a "boat propulsion unit".

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A boat comprising:

a hull;

a power source;

a remote control unit provided in the hull; and a boat propulsion unit controlled through the remote control unit so as to produce thrust for propelling the hull;

wherein the power source is connected to the remote control unit and the boat propulsion unit with at least two systems of power supply lines; and wherein the remote control unit and the boat propulsion unit are connected to each other with at least two systems of communication lines, wherein the power source comprises a battery and a power generating unit, the at least two systems of power supply lines being respectively connected to the battery and the power generating unit.

2. The boat according to claim 1, wherein the remote control unit and the boat propulsion unit respectively includes a remote control ECU and an engine ECU connected to each other with the communication lines, and wherein a position sensor for detecting a position of a remote control lever is connected to the remote control ECU with at least two systems of analog signal lines.

3. A boat comprising:

a hull;

a power source;

a remote control unit provided in the hull; and a boat propulsion unit controlled through the remote control unit so as to produce thrust for propelling the hull;

wherein the power source is connected to the remote control unit and the boat propulsion unit with at least two systems of power supply lines; and wherein the remote control unit and the boat propulsion unit are connected to each other with at least two systems of communication lines, wherein the remote control unit and the boat propulsion unit respectively includes a remote control ECU and an engine ECU connected to each other with the communication lines, and wherein a position sensor for detecting a position of a remote control lever is connected to the remote control ECU with at least two systems of analog signal lines.

4. A vehicle comprising a power source, a remote control unit, a propulsion unit controlled through the remote control unit so as to produce thrust for propelling the vehicle, at least two systems of power supply lines connecting the power source with the remote control unit and the propulsion unit, and at least two systems of communication lines connecting the remote control unit and the propulsion unit, wherein the power source comprises a battery and a power generating unit.

5. A vehicle comprising a power source, a remote control unit, a propulsion unit controlled through the remote control unit so as to produce thrust for propelling the vehicle, at least two systems of power supply lines connecting the power source with the remote control unit and the propulsion unit, and at least two systems of communication lines connecting the remote control unit and the propulsion unit, wherein the remote control unit and the propulsion unit respectively includes a remote control ECU and an engine ECU connected to each other with the communication lines, and wherein a position sensor for detecting a position of a remote control lever is connected to the remote control ECU with at least two systems of analog signal lines.

6. A vehicle comprising a power source, a remote control unit, a propulsion unit controlled through the remote control unit so as to produce thrust for propelling the vehicle, at least two systems of power supply lines connecting the power source with the remote control unit and the propulsion unit, and at least two systems of communication lines connecting the remote control unit and the propulsion unit, wherein the vehicle is a boat, and wherein the remote control unit and the propulsion unit respectively includes a remote control ECU and an engine ECU connected to each other with the communication lines, and wherein a position sensor for detecting a position of a remote control lever is connected to the remote control ECU with at least two systems of analog signal lines.

* * * * *

UNITED STATES PATENT AND TRADEMARK OFFICE

CERTIFICATE OF CORRECTION

PATENT NO. : 7,399,212 B2
APPLICATION NO. : 11/529142
DATED : July 15, 2008
INVENTOR(S) : Takashi Okuyama It is certified that error appears in the above-identified patent and that said Letters Patent is hereby corrected as shown below:

Title Page; item (73); On Page 1, Column 1 (Assignee), Line 1, delete "Marin" and insert --Marine--, therefor.

In Column 4, Line 67, delete "Can" and insert --CAN--, therefor.

In Column 5, Line 2, delete "Can" and insert --CAN--, therefor.

In Column 5, Line 5, after "ECU" insert --43 via a signal--.

In Column 6, Line 6, after "at" insert --least--.

In Column 6, Line 9, after ""b"" insert --of--.

In Column 6, Lines 30-33, after "extensibility." delete "Further,.....unit 14." and insert the same on Col. 6, Line 31 as a new paragraph.

Signed and Sealed this

Fourth Day of May, 2010

David J. Kappos

David J. Kappos
*Director of the United States Patent and Trademark Office*